US008469209B2

(12) United States Patent
Holmes et al.

(10) Patent No.: US 8,469,209 B2
(45) Date of Patent: Jun. 25, 2013

(54) REMOVAL APPARATUS FOR A TORQUE CONVERTER AND A STARTING MOTOR FROM AN AUXILIARY COMPARTMENT ON A GAS TURBINE

(75) Inventors: James Bradford Holmes, Fountain Inn, SC (US); Charles Van Buchan, Greer, SC (US); John William Herbold, Fountain Inn, SC (US)

(73) Assignee: General Electric Company, Schenectady, NY (US)

( * ) Notice: Subject to any disclaimer, the term of this patent is extended or adjusted under 35 U.S.C. 154(b) by 262 days.

(21) Appl. No.: 13/041,548

(22) Filed: Mar. 7, 2011

(65) Prior Publication Data

US 2012/0228254 A1 Sep. 13, 2012

(51) Int. Cl.
*B66C 1/00* (2006.01)

(52) U.S. Cl.
USPC ..... 212/251; 212/179; 212/259

(58) Field of Classification Search
USPC ..... 212/175, 179–181, 294, 299, 251, 212/259; 294/81.2, 81.5, 81.51, 81.56
See application file for complete search history.

(56) References Cited

U.S. PATENT DOCUMENTS

| | | | | |
|---|---|---|---|---|
| 4,508,233 | A * | 4/1985 | Helms | 212/294 |
| 5,232,257 | A * | 8/1993 | Koide et al. | 294/68.3 |
| 6,082,561 | A * | 7/2000 | Bembas | 212/180 |
| 2001/0003242 | A1 * | 6/2001 | Takamatsu et al. | 60/39.33 |

* cited by examiner

*Primary Examiner* — Emmanuel M Marcelo
*Assistant Examiner* — Angela Caligiuri
(74) *Attorney, Agent, or Firm* — Dority & Manning, PA

(57) ABSTRACT

A lifting fixture for attachment to a torque converter or starting motor within an auxiliary compartment of a gas turbine is provided. The lifting fixture generally includes a frame configured to attach to a hoisting support, a pair of lifting lugs attached to the frame and positioned above the frame, and a plurality of lifting hooks attached to the frame and positioned such that each lifting hook has a bend extending below the frame. A removal apparatus for moving a torque converter or starting motor within an auxiliary compartment of a gas turbine is also generally provided.

18 Claims, 10 Drawing Sheets

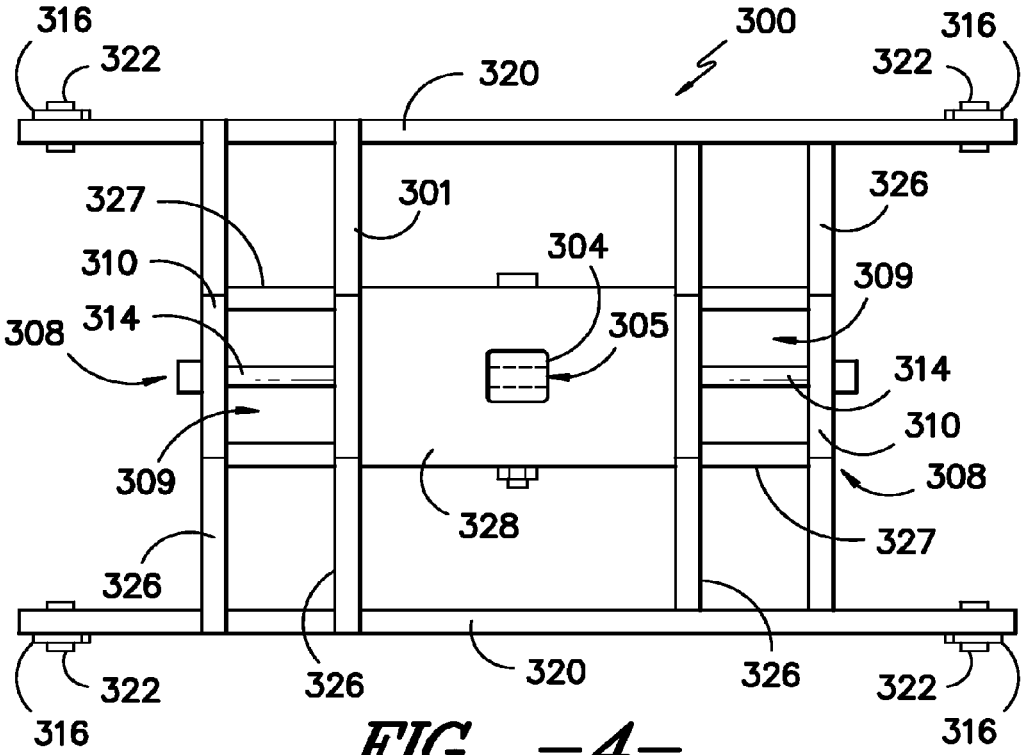
FIG. —4—
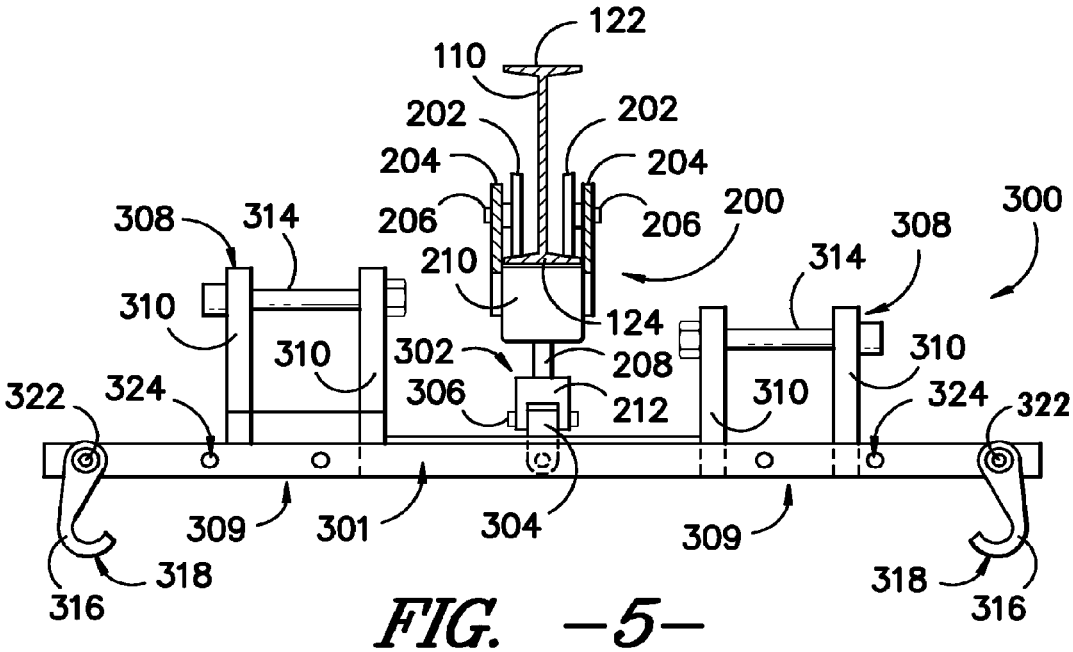
FIG. —5—

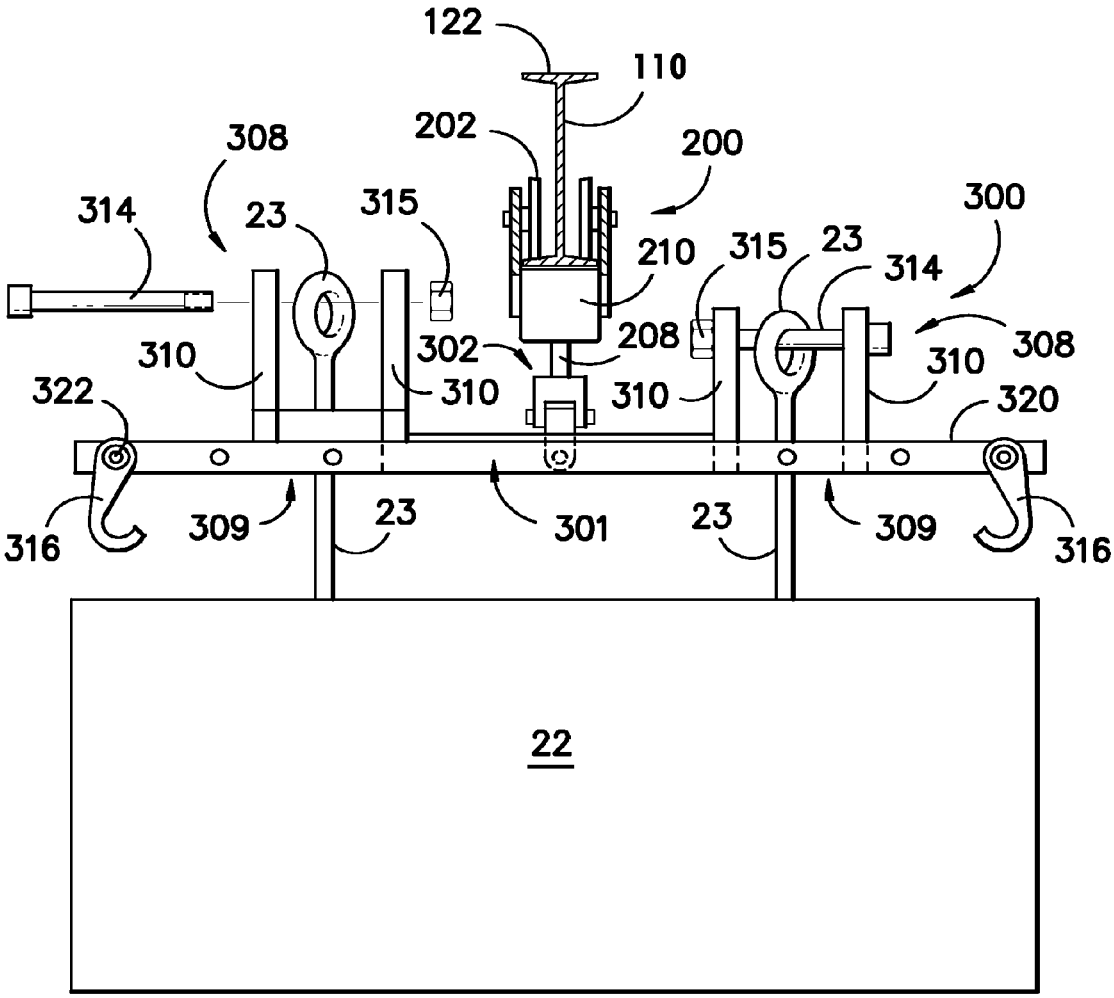
FIG. —6—

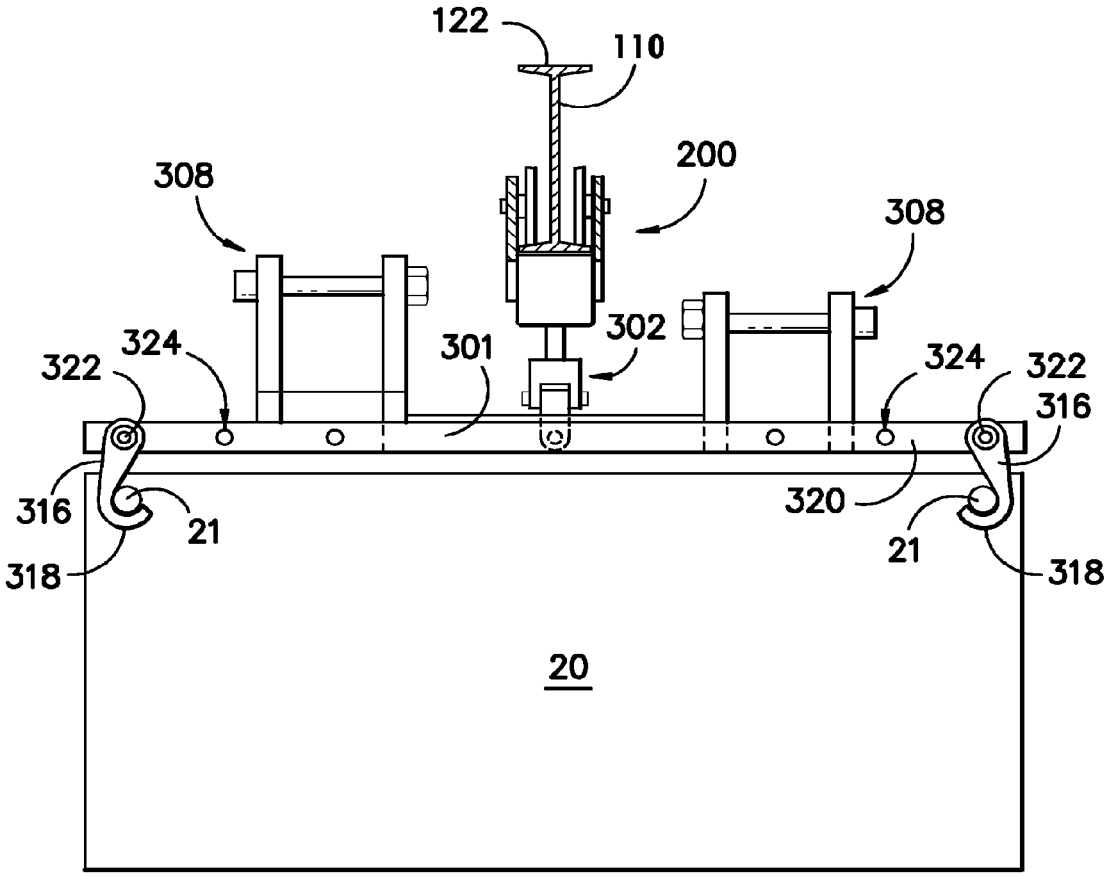
FIG. —7—

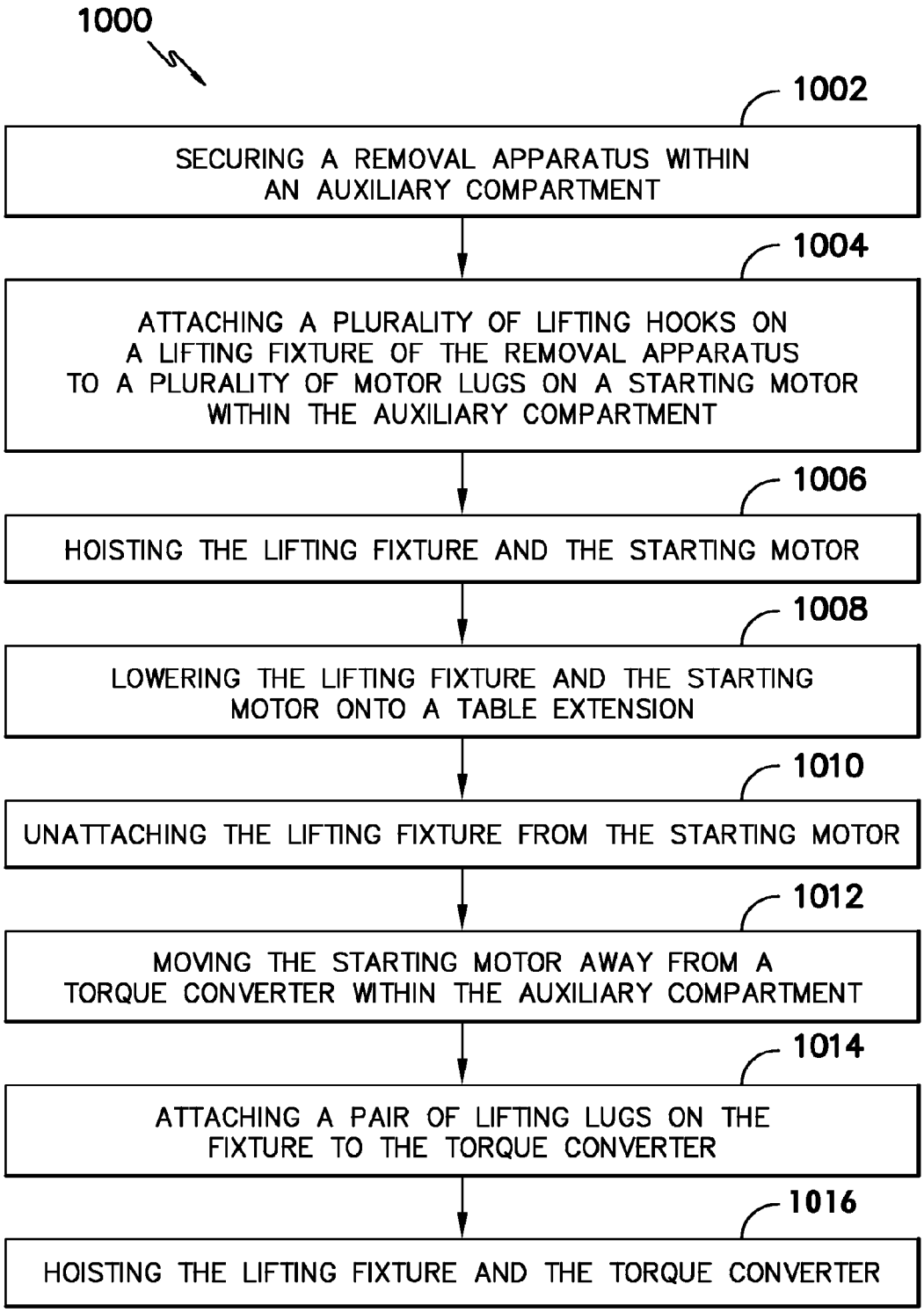
*FIG. —10—*

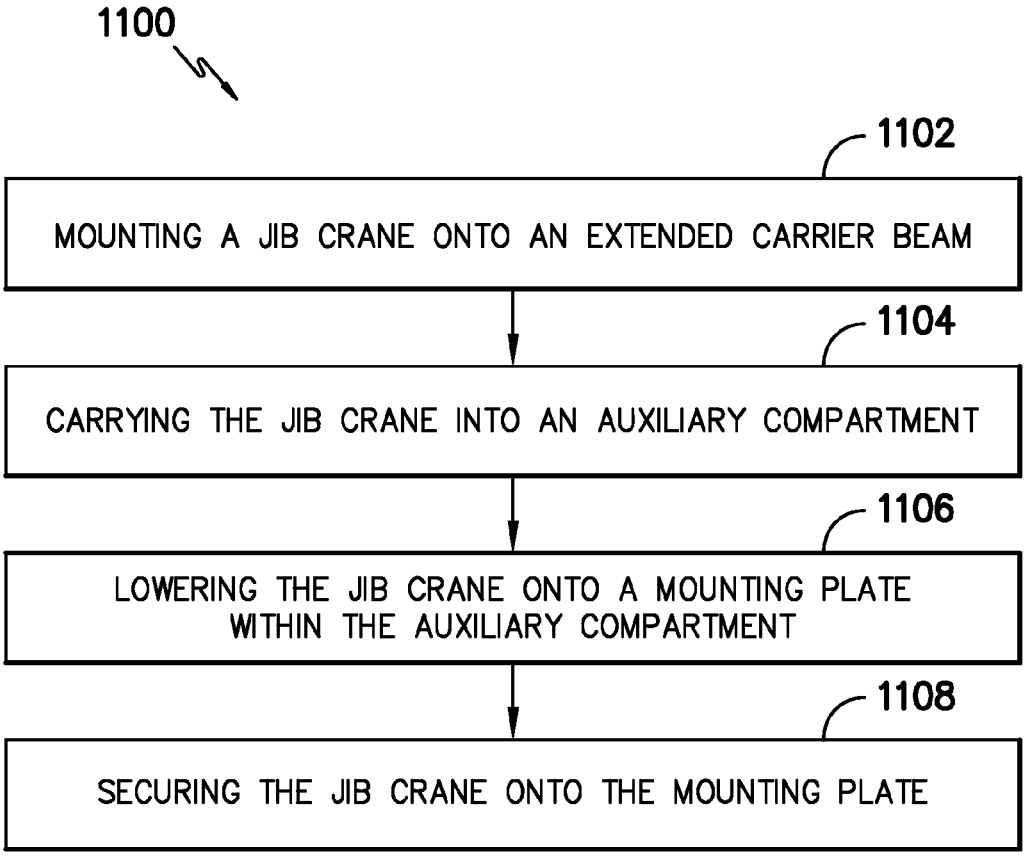
*FIG. —11—*

REMOVAL APPARATUS FOR A TORQUE CONVERTER AND A STARTING MOTOR FROM AN AUXILIARY COMPARTMENT ON A GAS TURBINE

FIELD OF THE INVENTION

The present invention generally relates to a removal apparatus for a torque converter and/or a starting motor of a gas turbine in a power plant. More particularly, the present invention relates to a jib crane having a lifting fixture configured to lift a torque converter and/or a starting motor within an auxiliary compartment of a gas turbine in a power plant.

BACKGROUND OF THE INVENTION

An auxiliary compartment is usually associated with a generator in a power plant. For example, gas turbines are widely used in commercial operations for power generation, acting as the generator in the power plant. The auxiliary compartment generally houses auxiliary equipment that provides a mechanism to supply energy to the generator (e.g., a gas turbine) to re-start the generator in the event the generator has been shut down. For example, the auxiliary compartment can house a starting motor and a torque converter as part of a starting system for providing the initial momentum for the gas turbine to reach the operating speed. Specifically, the starting motor with a torque converter is configured to bring the heavy mass of the turbine to a required speed before the turbine can work on its own inertia. For large gas turbines, this process requires a large capacity starting motor and torque converter. For example, the starting motor and torque converter can each weight about 2,000 kilograms or more.

During maintenance of the power plant and/or the gas turbine, it is often desired or necessary to remove the starting motor and/or torque converter from the auxiliary compartment. However, due to extremely limited headspace in the auxiliary compartment (designed to keep as small a profile as possible) and no support structure for lifting heavy equipment, removal of the starting motor and/or torque converter has presented engineering challenges in the past. In certain embodiments, the entire space from the floor to the roof inside the auxiliary compartment can be about 6 feet or less. One method typically used to remove the starting motor and/or torque converter is to construct a slide or skid of I-beams and a plate during each outage for removal, requiring the slide to be fabricated and welded to the existing motor mounting structure in the auxiliary compartment. Then, after the maintenance is complete, the complete structure is cut out and discarded. Alternatively, the roof of the auxiliary compartment can be customized to include an access port large enough for removal (e.g., with an external crane) of the starting motor and/or torque converter. However, such a roof would have to be outfitted with a removable section that can be reinstalled after the maintenance has been completed. Not only would this type of roof would be expensive and add the potential for leakage.

As such, a need exists for an apparatus and method configured to facilitate removal of the starting motor and/or torque converter from the auxiliary compartment associated with a gas turbine.

BRIEF DESCRIPTION OF THE INVENTION

Aspects and advantages of the invention will be set forth in part in the following description, or may be obvious from the description, or may be learned through practice of the invention.

A lifting fixture is generally described for attachment to a torque converter or starting motor within an auxiliary compartment of a gas turbine. The lifting fixture generally includes a frame configured to attach to a hoisting support, a pair of lifting lugs attached to the frame and positioned above the frame, and a plurality of lifting hooks attached to the frame and positioned such that each lifting hook has a bend extending below the frame.

The frame can, in one embodiment, define a pair of openings, such that each lifting lug is positioned over an opening in the frame allowing each lifting lug to be attached to a connection loop extending through the frame. Alternatively or additionally, the frame can include a plurality of side bars, where each lifting hook is removably attached along at least one of the side bars. For example, the side bars can be oriented substantially parallel to each other, and can define a plurality of apertures configured to allow attachment of a lifting hook. A cross bar can be oriented in a direction substantially perpendicular to the side bars. Additionally, the frame can further include a frame plate attached to at least one of the side bars or the cross bar. The frame can further define a fixture member for coupling with a trolley member on the hoisting support to form a hinge joint. In one embodiment, each lifting lug can include a first lug plate, a second lug plate, and a lug rod such that the lug rod is removably secured through a first aperture defined in the first lug plate and a second aperture in the second lug plate.

A removal apparatus for moving a torque converter or starting motor within an auxiliary compartment of a gas turbine is also generally provided. The apparatus generally includes a jib crane secured within the auxiliary compartment, a trolley system moveably secured to a beam of the jib crane, and a lifting fixture attached to the trolley system. In one embodiment, the lifting fixture includes a pair of lifting lugs and a plurality of lifting hooks, such as described above.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 4 provides a top view of the lifting fixture of the exemplary removal apparatus shown in FIG. 2;

FIG. 5 provides another side view of the lifting fixture of the exemplary removal apparatus shown in FIG. 2;

FIG. 6 shows exemplary attachment for securing a pair of lifting lugs on the lifting fixture of FIGS. 3-5 to a torque converter;

FIG. 7 shows exemplary attachment for securing the lifting hooks on the lifting fixture of FIGS. 3-5 to a starting motor;

FIG. 10 shows a diagram of exemplary steps according to one embodiment of a method of the present invention; and FIG. 11 shows a diagram of exemplary steps according to one embodiment of a method of the present invention.

DETAILED DESCRIPTION OF THE INVENTION

Figure 1:
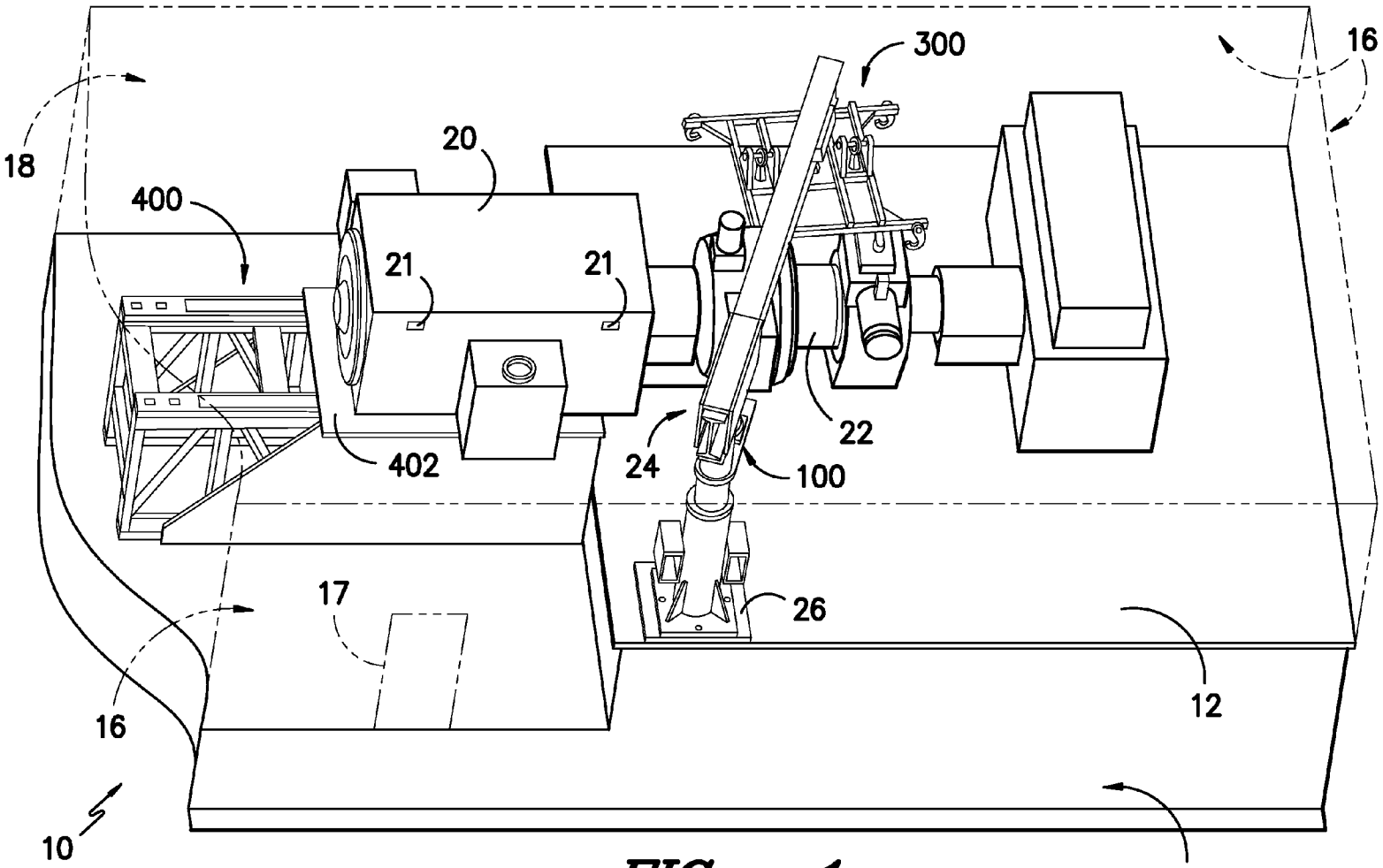
FIG. 1 provides a perspective view of an exemplary auxiliary compartment of a gas turbine including an exemplary removal apparatus according to one embodiment of the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Apparatus and methods are generally provided for moving a torque converter or starting motor within an auxiliary compartment of a gas turbine. For example, the presently disclosed apparatus and methods can allow for removal of the torque converter or starting motor from the auxiliary compartment without having to damage the roof or otherwise build a custom removal apparatus. As such, the apparatus and methods can be utilized to facilitate maintenance of the torque converter or starting motor within an auxiliary compartment.

FIG. 1 generally shows the components of an auxiliary compartment 10 of a gas turbine. As shown, the auxiliary compartment 10 is defined over the floor 12 and positioned on the oil tank 14 of the gas turbine. As known in the art, the auxiliary compartment is encased by surrounding walls 16 (shown in phantom) and a roof 18 (shown in phantom), and is accessible through door 17. The auxiliary compartment 10 houses the starting motor 20 and torque converter 22, among other components of the gas turbine. As stated, the starting motor 20 and a torque converter 22 are configured to bring the heavy mass of the turbine to a required speed before the turbine can work on its own inertia.

A removal apparatus 24 is removably secured in the auxiliary compartment 10. As shown, the removal apparatus 24 includes a jib crane 100 secured to a mount plate 26 in the auxiliary compartment 10. For example, the mount plate 26 can be welded to the floor 12 of the auxiliary compartment 10 (e.g., welded to the oil tank 14 of the gas turbine forming the floor 12). In order to secure the jib crane 100 to the mount plate 26, the base plate 102 of the jib crane 100 can include apertures 103 for receiving bolts configured to secure the base plate 102 on the jib crane 100 to the mount plate 26 within the auxiliary compartment 10. The removal apparatus 24 is shown generally including a trolley system 200 movably attached to the jib crane 100, and a lifting fixture 300 pivotally attached to the trolley system 200.

Figure 2:
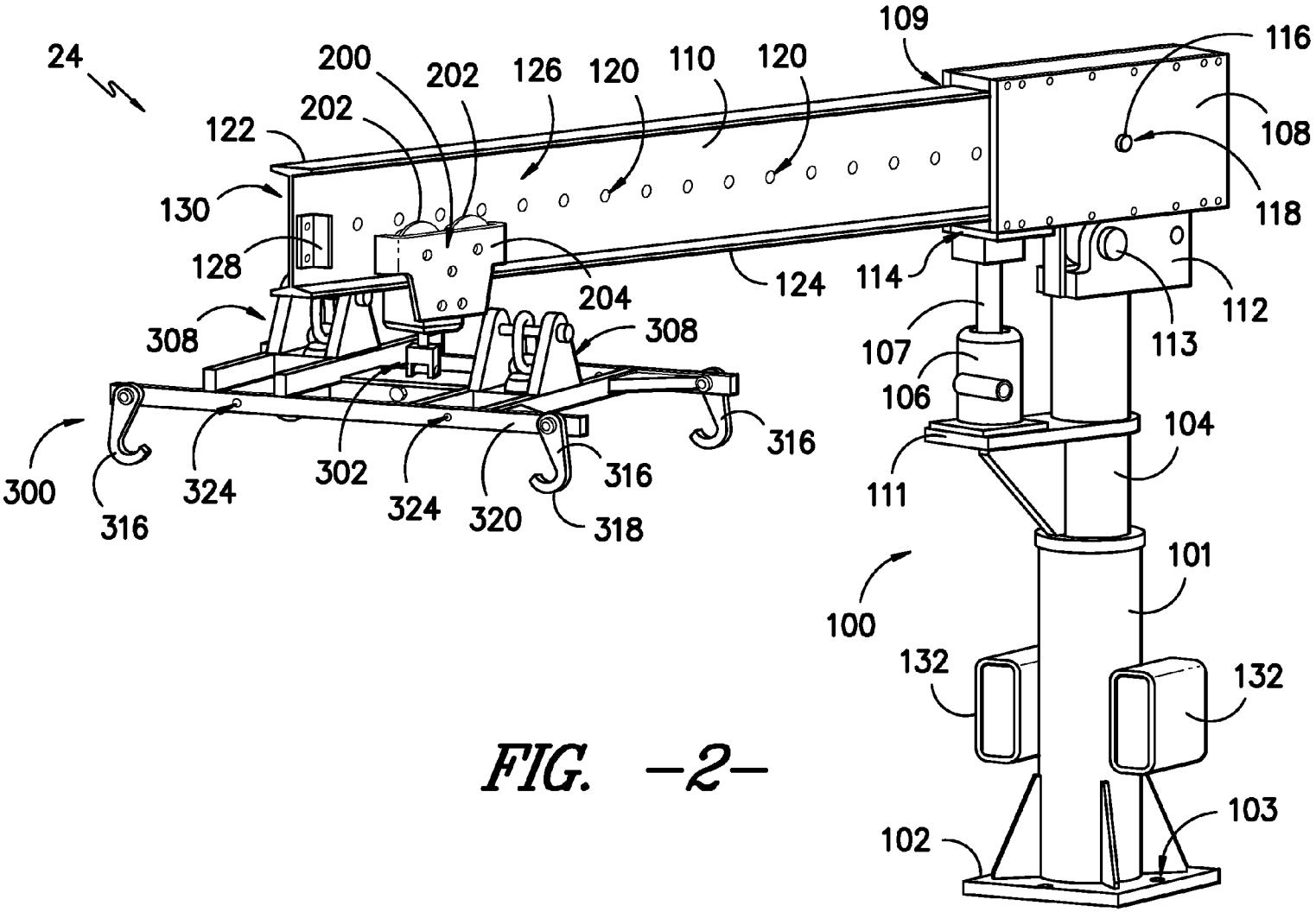
FIG. 2 provides a perspective view of the exemplary removal apparatus shown in FIG. 1.

Referring to FIG. 2, the jib crane 100 generally includes a base plate 102, a mast 104, a jack 106, a receiver 108, and a beam 110. As stated, the base plate 102 is configured to be removably secured within the auxiliary compartment 10 (e.g., via attachment to the mount plate 26). The mast 104 is rotatably secured within the base tube 101 attached to the base plate 102, allowing the mast 104 (and consequently the beam 110) to be rotated 360° as desired. Thus, the jib crane 100 can be utilized to move the workpiece (e.g., the starting motor 20 or the torque converter 22) to a desired location by rotating the mast 104 within the base tube 101.

A receiver 108 is pivotally mounted and coupled to the mast 104 at a pivot joint 112 configured to allow vertical movement (i.e., raising and lowering) of the first end 109 of the receiver 108. As show, the pivot joint 112 allows for rotation of the receiver 108 around the pivot rod 113. This vertical movement is controlled by a jack 106 (e.g., a hydraulic jack). As shown, the jack 106 is mounted on a platform 111 attached to the mast 104. The arm 107 of the jack 106 extends to contact the bottom surface 114 of the receiver 108 near its first end 109 to control the vertical movement thereof (i.e., raising and/or lowering).

The beam 110 extends from the first end 109 of the receiver 108. As shown, the beam 110 is sized to be fit within the interior of the receiver 108. A securing rod 116 (e.g., a bolt, pin, etc.) extends through a pin hole 118 in the receiver 108 and a beam aperture 120 on the beam 110 to secure the beam 110 at the desired beam length extending from the first end 109 of the receiver 108. As such, the beam length can be adjusted by removing the securing rod 116 from the pin hole 118 and sliding the beam 110 along its length within the receiver 108. A plurality of beam apertures 120 allow for the beam 110 to be secured, using the securing rod 116, at various beam lengths. The beam 110 is generally shown as having an I-beam shape with a pair of horizontal flanges 122 and 124 and a vertical web 126; however, any suitable beam shape or length can be utilized.

Figure 3:
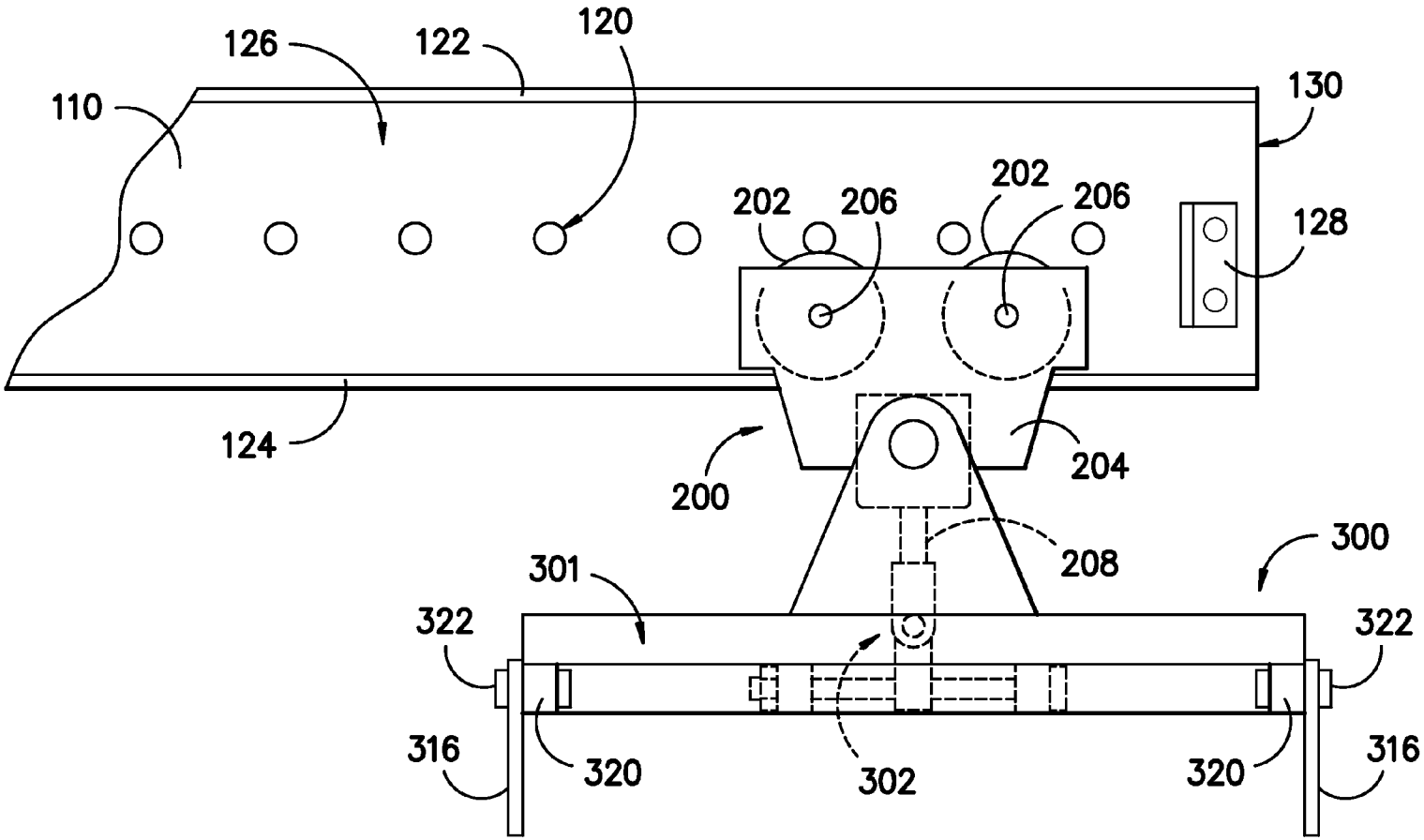
FIG. 3 provides a close-up side view of the trolley system and lifting fixture of the exemplary removal apparatus shown in FIG. 2.

The trolley system 200 is moveably attached to the beam 110 of the jib crane 100. As best shown in FIG. 3, the trolley system 200 is moveably secured to the beam such that the trolley system 200 can be moved along the length of the beam as desired. The trolley system includes wheels 202 configured to roll along the bottom horizontal flange 124 of the beam 110 allowing the trolley system 200 to move along the length of the beam 110. The wheels 202 are attached to the wheel housing 204 and are rotatable about the axle 206. The wheel housing 204 is sized to keep the wheels 202 in substantially continuous contact with the bottom horizontal flange 124 of the beam.

The beam 110 includes a removable stopper 128 positioned at the far end 130 of the beam 110 opposite from the receiver 108 allowing the trolley system 200 to be attached to the beam 110 (when the stopper 128 is removed from the beam 110) and preventing the trolley system 200 from sliding off the beam 110 (when the stopper 128 is secured onto the beam 110).

A trolley rod 208 extends from the wheel housing 204 to connect the trolley system 200 to the lifting fixture 300. As shown, the trolley rod 208 extends from a rod housing 210 attached to the wheel housing 204, where the trolley rod 208 is rotatably connected to the rod housing 210 to allow rotating of the trolley rod 208 in 360°. For example, the trolley rod 208 and the rod housing 210 can form a ball joint or other rotational coupling.

Referring to FIGS. 2-5, the lifting fixture 300 is pivotally attached to the trolley system 200 at a hinge joint 302. In the embodiment shown, the fixture member 304 couples with the trolley member 212 on the trolley rod 208 to form the hinge joint 302 allowing the lifting fixture 300 to pivot around the hinge pin 306. The combination of the hinge joint 302 pivotally connecting the lifting fixture 300 to the trolley system 200 and the rotatably connected trolley rod 208 and trolley housing enables the lifting fixture 300 to be oriented in numerous positions.

The lifting fixture 300 is configured to lift either the starting motor 20 or the torque converter 22 of the gas turbine within the auxiliary room 10. Generally, the lifting fixture 300 includes a frame 301, a pair of lifting lugs 308, and a plurality of lifting hooks 316. The frame 301 is configured to attach to the trolley rod 208, which acts as a hoisting support for the lifting fixture 300.

The pair of lifting lugs 308 are attached to the frame 301 and generally positioned above the frame 301 (i.e., on the same side of the frame 301 as the trolley rod 208). However, as shown, the pair of lifting lugs 308 are accessible from below the lifting fixture 300 (i.e., accessible from an opposite side of the trolley system 200). For example, each lifting lug 308 can be positioned above an opening 309 in the frame 301. In the exemplary embodiment shown, each lifting lug 308 includes a pair of lug plates 310, where each lug plate 310 includes a lug aperture 312. The lug plates 310 are positioned such that their respective lug apertures 312 are aligned allowing a lug rod 314 (e.g., a bolt, pin, or other bar-like structure) to be secured therethrough.

Each lifting lug 308 is configured to attach to a connection loop 23 (e.g., an eye bolt, a chain link, etc.) on the torque converter 22. As specifically shown in FIG. 6, the connection loops 23 of the torque converter 22 pass through the opening 309 in the frame 301 allowing for connection to the lifting lugs 308. The lug rod 314 is inserted into the lug aperture of a first lug plate 310, inserted through the connection loop 23 attached to the torque converter 22, and inserted through the aperture 312 of the second lug plate 310. The embodiment shown in FIG. 6 represents the lug rod 314 secured to the lug plates 310 using a lug nut 315.

In one particular embodiment, the lifting lugs 308 are positioned on the frame 301 at substantially the same distance from the hinge joint 302 on opposite sides of the fixture member 304. Additionally, each of the lifting lugs 308 can be positioned along the frame 301 in the linear axis defined by the orientation of the hinge pin 306 (to be inserted in the hinge opening 305) of the fixture member 304 to form the hinge joint 302 with the trolley member 212. Thus, the lug rods 314 and the hinge pin 306 can be oriented in a substantially parallel direction. As such, any weight supported by the lifting lugs 308 can be substantially balanced on the frame 301, while substantially preventing undesired rotation of the hinge joint 302. Additionally, upon attaching a load to the lifting lugs 308, the lifting fixture 300 can be balanced in a substantially horizontal position (relative to the ground), no matter the orientation of the beam 110 and the trolley rod 208.

The plurality of lifting hooks 316 are attached to the frame 301 and generally positioned such that each lifting hook 316 has a bend 318 extending below the frame 301. As shown, the lifting hooks 316 are attached to side bars 320 of the frame 301. The side bars 320, in one particular embodiment, can by substantially parallel to each other. Additionally, in one particular embodiment, the side bars 320 and the hinge pin 306 can be oriented in a substantially parallel direction. As such, any weight supported by the lifting lugs 308 can be substantially balanced on the frame 301, while substantially preventing undesired rotation of the hinge joint 302. Additionally, upon attaching a load to the lifting hooks 316, the lifting fixture 300 can be balanced in a substantially horizontal position (relative to the ground), no matter the orientation of the beam 110 and the trolley rod 208.

The lifting hooks 316 can be removably attached to the side bars 320 using a hook rod 322 (e.g., a bolt, pin, or other bar-like structure) at any position along the length of the side bars 320 using the side apertures 324. As shown in FIG. 7, the lifting hooks 316 are positioned to allow the hook bend 318 to grip a motor lug 21 on the starting motor 20. If desired, a connecting strap (e.g., a strap, a rope, a wire, etc.) can be attached to the lifting fixture 300 and the starting motor 20 to help hold the plurality of lifting hooks 316 in place around the motor lugs 21 on the starting motor 20.

The removal apparatus 24 can be used to move the starting motor 20 within the auxiliary compartment 10 of a gas turbine. For example, FIG. 10 shows a diagram of an exemplary method 1000 for moving the starting motor by securing the removal apparatus within the auxiliary compartment at 1002. As shown in FIGS. 1-5, the removal apparatus 24 generally can include a lifting fixture 300 attached to a beam 110 pivotally coupled on a mast 104. A plurality of lifting hooks can be attached to a plurality of motor lugs on the starting motor at 1004. For example, as shown in FIG. 7, the lifting hooks 316 are attached to the motor lugs 21 of the starting motor 20. At 1006, the lifting fixture and the starting motor can be hoisted. For example, referring to FIG. 2, the jack 106 can extend its arm 107 to lift the first end 109 of the receiver 108, causing the beam 110 to pivot vertically upward to lift the trolley system 200 and the lifting fixture 300.

Cross-bars 326 are shown attached to the side bars 320 to assemble the frame 301 as a single structure. Each cross-bar 326 is oriented in a direction that is substantially perpendicular to the side bars 320 and have a length sufficient to connect to each side bars 320 to form the frame 301. Each of the lug plates 310 are shown mounted on a respective cross-bar 326 to provide structural support for any weight attached to the lifting lugs 308. Additionally, a frame plate 328 is shown spanning at least two cross-bars 326 to provide a support structure for mounting the frame member 304 to the frame 301. Other support bars 327 are shown in the frame 301.

In one particular embodiment, the components of the lifting fixture 300 (e.g., the frame 301, the lifting lugs 308, and/or the lifting hooks 316) can be constructed from a hardened material (e.g., a metallic composition, such as steel) configured to support hoisting relatively heavy loads (e.g., about 2,000 kilograms to about 4,000 kilograms) using either the lifting lugs 308 or the lifting hooks 316.

After hoisting the lifting fixture and the starting motor at 1006, the lifting fixture and the starting motor can be lowered onto an extension such that the starting motor rests on the extension at 1008, and the plurality of lifting hooks can be unattached from the starting motor at 1010. For example, the extension could be slid (e.g., the extension can include wheels for rolling the extension) under the starting motor prior to lowering the lifting fixture and the starting motor. Alternatively, the mast of the jib crane attached to the lifting fixture can be rotated to position the starting motor over the table or the extension.

Figure 8:
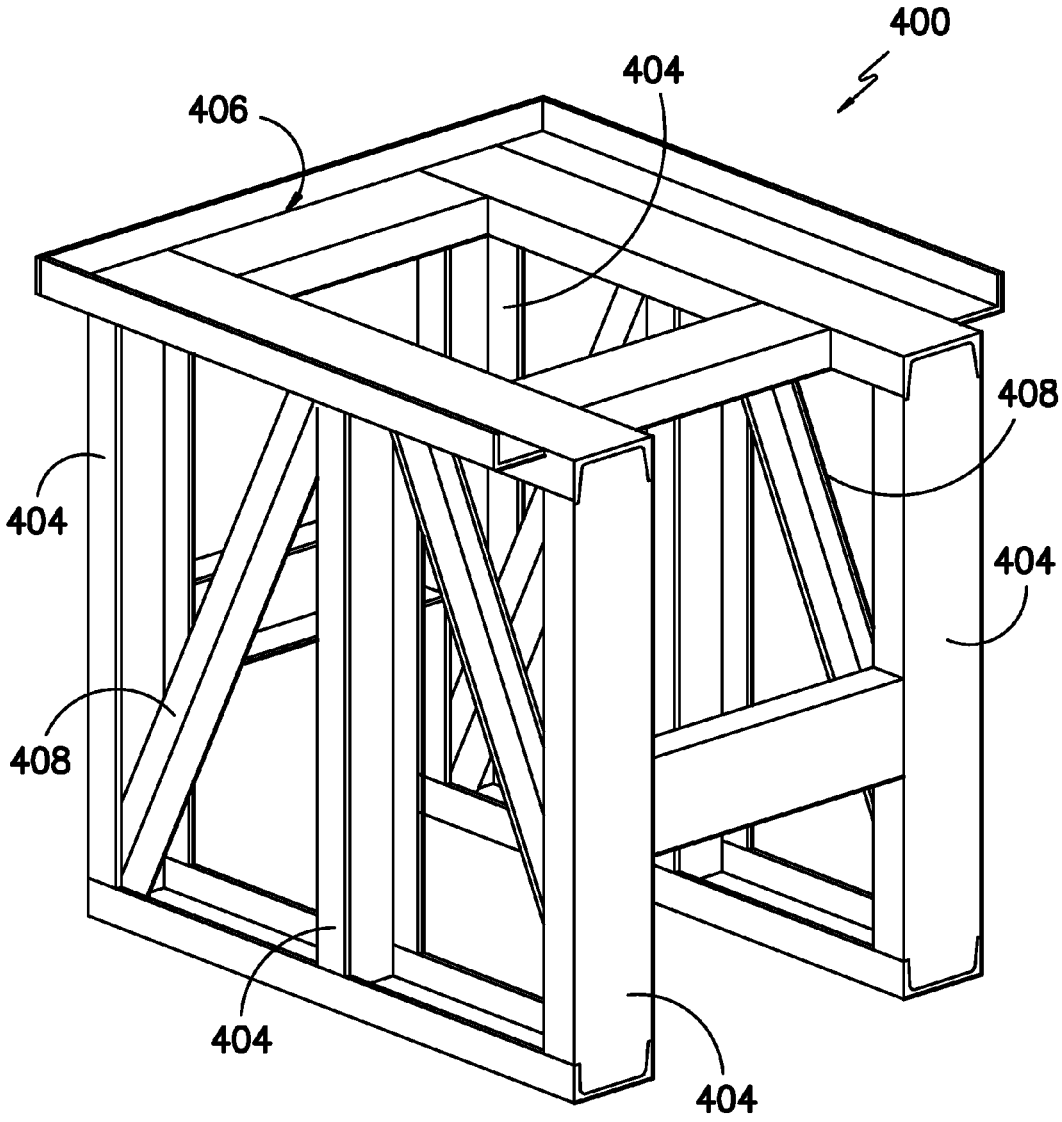
FIG. 8 shows an exemplary extension platform for temporarily supporting a starting motor within the auxiliary compartment to allow access to the torque converter.

At 1012, the extension and the starting motor are optionally moved away from the torque converter within the auxiliary compartment. In the embodiment shown in FIG. 1, for instance, the extension 402 can be slid onto an extension platform 400 that extends from an edge of the floor 12 within the auxiliary compartment 10. The extension platform 400 is shown more completely in FIG. 8, and generally includes support beams 404 positioned substantially vertically to support the platform surface 406. Diagonal beams 408 are included to add support strength to the extension platform to help distribute weight of any workpiece (e.g., the starting motor on the table) placed thereon.

Referring again to FIG. 10, the pair of lifting lugs on the lifting fixture can then be optionally attached to the torque converter at 1014, and the lifting fixture and the torque converter can then be hoisted at 1016. The torque converter can then be positioned as desired (e.g., by rotating the mast of the removal apparatus to move the torque converter to the desired location).

Figure 9:
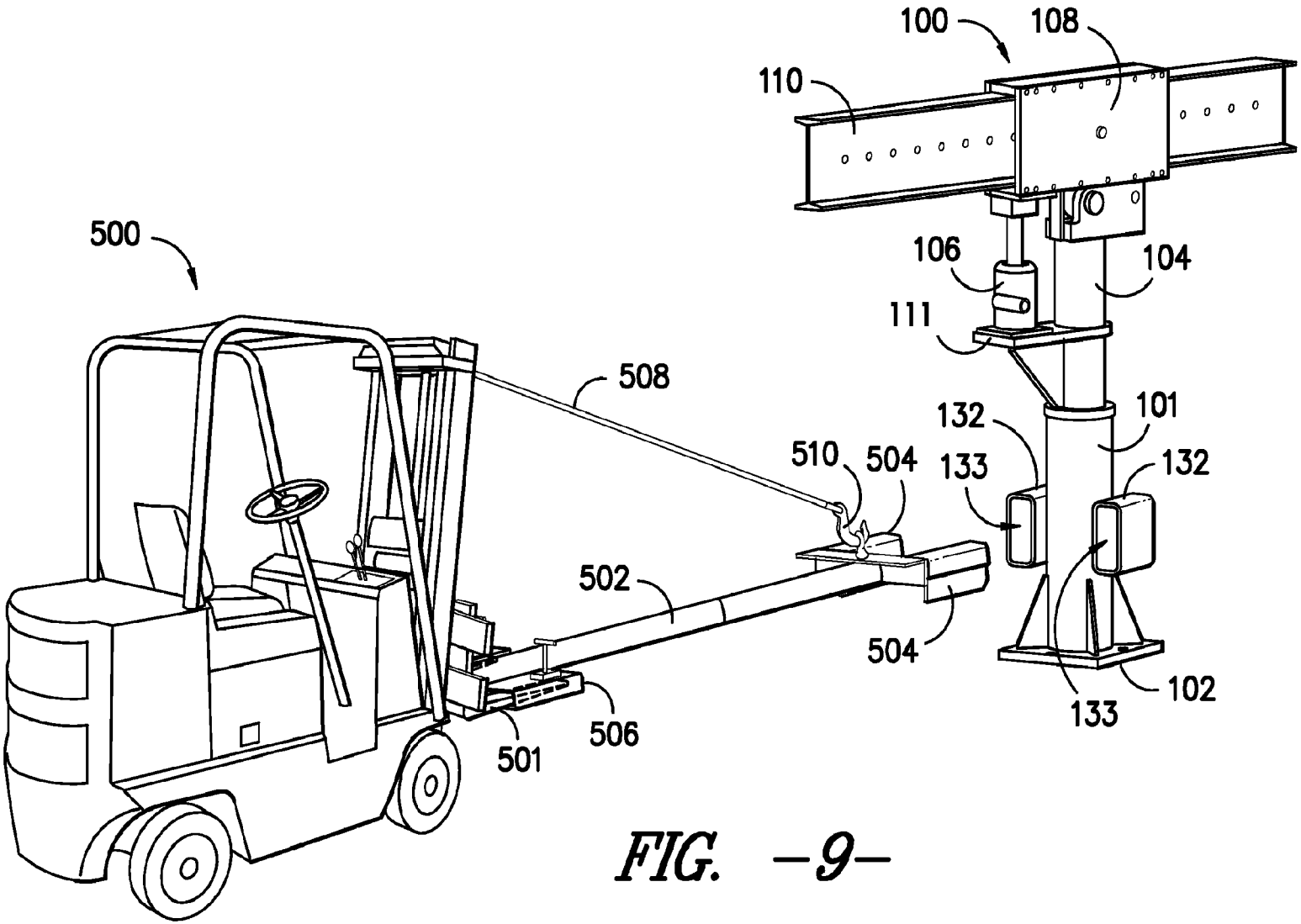
FIG. 9 shows an exemplary delivery system and method for installing the removal apparatus into the auxiliary compartment.

The removal apparatus 24 can be inserted into the auxiliary compartment 10 using a fork lift 500 as shown in FIG. 9. As shown, the jib crane 100 includes a pair of delivery brackets 132 attached to the base tube 101 for transporting the jib crane 100. The delivery brackets 132 can be coupled to the fork lift 500 using the extension beam 502. The extension beam 502 includes bracket tongs 504 configured to be inserted within the interior 133 of the delivery brackets 132. The length of the extension beam 502 can be tailored to ensure that the jib crane 100 can be inserted and positioned in the auxiliary compartment without having the fork lift 500 enter the auxiliary compartment 10, since the fork lift 500 is too large for the typical door 17 and/or the dimensions of the typical auxiliary room 10. For example, the extension beam 502 can have a length of about 3 meters to about 7 meters (e.g., about 4 meters to about 6 meters). As such, the extension beam 502 can carry the jib crane 100 for transporting to and positioning within the auxiliary compartment 10.

The extension beam 502 can be mounted onto the fork lift 500 by coupling an extension bracket 506 attached to the extension beam 502 on the prongs 501 of the fork lift 500. A support cable 508 (e.g., a wire, rope, chain, or other cable-like material) is shown attached to the fork lift at one end and to the extension beam 502 at its opposite end to help support the weight of the extension beam 502 and the jib crane 100. As shown, the support cable 508 attaches to the extension beam 502 near the bracket tongs 504 using the clasp 510.

FIG. 11 shows a diagram describing an exemplary method 1100 for securing a removal apparatus within an auxiliary compartment of a gas turbine. At 1102, a jib crane is mounted onto an extended carrier beam, wherein the extended carrier beam comprises bracket prongs configured to couple within a delivery bracket on the jib crane. At 1104, the jib crane can be carried into the auxiliary compartment, and lowered onto a mounting plate within the auxiliary compartment at 1106. Then, the jib crane can be secured onto the mounting plate at 1108.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A lifting fixture for attachment to a torque converter or starting motor within an auxiliary compartment of a gas turbine, the lifting fixture comprising:

a frame configured to attach to a hoisting support above the frame;

a pair of lifting lugs attached to the frame and positioned above the frame, wherein each lifting lug comprises a first lug plate, a second lug plate, and a lug rod, wherein the first lug plate and the second lug plate are each attached to the frame such that they extend above the frame, wherein the first lug plate and the second lug plate each define an aperture above the frame, and wherein the lug rod is removably secured through the apertures; and a plurality of lifting hooks attached to the frame and positioned such that each lifting hook has a bend extending below the frame.

2. The lifting fixture as in claim 1, wherein the frame defines a pair of openings.

3. The lifting fixture as in claim 1, wherein each lifting lug is positioned over an opening in the frame such that each lifting lug is configured to be attached to a connection loop extending through the frame.

4. The lifting fixture as in claim 1, wherein the frame comprises a plurality of side bars, and wherein each lifting hook is removably attached along at least one of the side bars.

5. The lifting fixture as in claim 4, wherein the side bars are substantially parallel to each other.

6. The lifting fixture as in claim 4, wherein each side bar defines a plurality of apertures configured to allow attachment of a lifting hook.

7. The lifting fixture as in claim 4, wherein the frame further comprises a cross bar oriented in a direction substantially perpendicular to the side bars.

8. The lifting fixture as in claim 7, wherein the frame further comprises a frame plate attached to at least one of the side bars or the cross bar.

9. The lifting fixture as in claim 1, wherein the frame defines a frame member for coupling with a trolley member on the hoisting support to form a hinge joint.

10. A removal apparatus for moving a torque converter or starting motor within an auxiliary compartment of a gas turbine, the apparatus comprising:

a jib crane secured within the auxiliary compartment, wherein the jib crane comprises a beam;

a trolley system moveably secured to the beam; and a lifting fixture attached to the trolley system, wherein the lifting fixture comprises a pair of lifting lugs and a plurality of lifting hooks attached to a frame, wherein each lifting lug comprises a first lug plate, a second lug plate, and a lug rod, wherein the first lug plate and the second lug plate are each attached to the frame such that they extend above the frame, wherein the first lug plate and the second lug plate each define an aperture above the frame, and wherein the lug rod is removably secured through the apertures.

11. The apparatus as in claim 10, wherein the lifting fixture is pivotally attached to a trolley rod of the trolley system.

12. The apparatus as in claim 11, wherein each lifting lug is positioned on the lifting fixture at a substantially equal distance from the trolley rod on opposite sides.

13. The apparatus as in claim 10, wherein each lifting hook comprises a bend extending below the frame.

14. The apparatus as in claim 10, wherein each lifting lug is positioned on the frame above an opening in the frame such that each lifting lug is configured to be attached to a connection loop extending through the frame.

15. The apparatus as in claim 10, wherein the jib crane further comprises a receiver pivotally coupled to a mast, wherein the beam extends from the receiver.

16. The apparatus as in claim 15, wherein the mast is secured within the auxiliary compartment via attachment of a base plate on the mast to a mount plate in the auxiliary compartment.

17. The apparatus as in claim 15, wherein the beam is slideably coupled within the receiver to adjust its reach length.

18. The apparatus as in claim 15, wherein the jib crane further comprises a delivery bracket attached to the mast.

* * * * *